US008356958B2

(12) United States Patent
Braun et al.

(10) Patent No.: US 8,356,958 B2
(45) Date of Patent: Jan. 22, 2013

(54) PAVER AND METHOD

(75) Inventors: Arthur Braun, Deidesheim (DE); Christian Pawlik, Neustadt (DE); Thomas Schmidt, Plankstadt (DE)

(73) Assignee: Joseph Vögele AG, Ludwigshafen/Rhein (DE)

( * ) Notice: Subject to any disclaimer, the term of this patent is extended or adjusted under 35 U.S.C. 154(b) by 348 days.

(21) Appl. No.: 12/722,478

(22) Filed: Mar. 11, 2010

(65) Prior Publication Data

US 2010/0296866 A1 Nov. 25, 2010

(30) Foreign Application Priority Data

May 25, 2009 (EP) ..... 09006978

(51) Int. Cl.
*E01C 19/12* (2006.01)
*E01C 23/14* (2006.01)
*E01C 19/22* (2006.01)

(52) U.S. Cl. ..... 404/101; 404/79; 404/118

(58) Field of Classification Search ..... 404/101, 404/118, 119, 79, 72; 180/65.31, 53.1, 53.4, 180/53.6, 53.8
See application file for complete search history.

(56) References Cited

U.S. PATENT DOCUMENTS

| | | | | |
|---|---|---|---|---|
| 2,382,096 | A * | 8/1945 | Pierce | 404/115 |
| 2,660,892 | A * | 12/1953 | Ross | 74/15.63 |
| 2,911,892 | A * | 11/1959 | Pollitz | 404/84.05 |
| 3,055,280 | A * | 9/1962 | Neville | 404/95 |
| 3,665,821 | A * | 5/1972 | Walker | 404/98 |
| 7,220,079 | B2 * | 5/2007 | Lee et al. | 404/101 |
| 7,870,915 | B2 * | 1/2011 | Beeson et al. | 180/53.1 |
| 2002/0003051 | A1 * | 1/2002 | Ishii et al. | 180/53.6 |
| 2002/0122727 | A1 | 9/2002 | Gaither | |
| 2003/0113166 | A1 * | 6/2003 | Heims | 404/118 |
| 2005/0074284 | A1 * | 4/2005 | Lee et al. | 404/108 |
| 2008/0149405 | A1 * | 6/2008 | Hladun et al. | 180/53.8 |

FOREIGN PATENT DOCUMENTS

| | | | |
|---|---|---|---|
| DE | 1905312 | U1 | 11/1964 |
| DE | 2112327 | A1 | 10/1971 |
| DE | 3611664 | A1 | 10/1987 |
| DE | 3911401 | C1 | 3/1990 |
| DE | 10300745 | | 7/2004 |
| DE | 20305577 | U1 | 9/2004 |
| DE | 20316481 | U1 | 4/2005 |
| EP | 0489969 | | 6/1992 |
| EP | 1118714 | | 7/2001 |

* cited by examiner

*Primary Examiner* — Thomas B Will
*Assistant Examiner* — Abigail A Risic
(74) *Attorney, Agent, or Firm* — Fish & Richardson P.C.

(57) ABSTRACT

In a paver F comprising a combustion engine M, in particular a diesel engine, of a primary driving aggregate P, functional units having hydraulic pumps 23, 30 to 33 inclusive a travel pump aggregate 23 which can be driven by the combustion engine M for supplying at least one travel drive 16, a generator G for supplying electric heating devices H of the paver F and/or of a paving screed B of the paver F with electric power, the generator G is driven permanently while at least one pump 23, 30 to 33 selectively can be disconnected from the combustion engine via at least one shiftable clutch K1, K2, K3. During a heating-up phase of electric heating devices H via the permanently driven generator G at least one of the pumps is disconnected. During transport travel at least one pump of the functional units, except the permanently driven travel pump aggregate 23 and the generator G, is disconnected. During start and, optionally, during warm-up of the combustion engine M pumps of functional units, optionally including the travel pump aggregate 23, are disconnected.

10 Claims, 3 Drawing Sheets

PAVER AND METHOD

Figure 1:
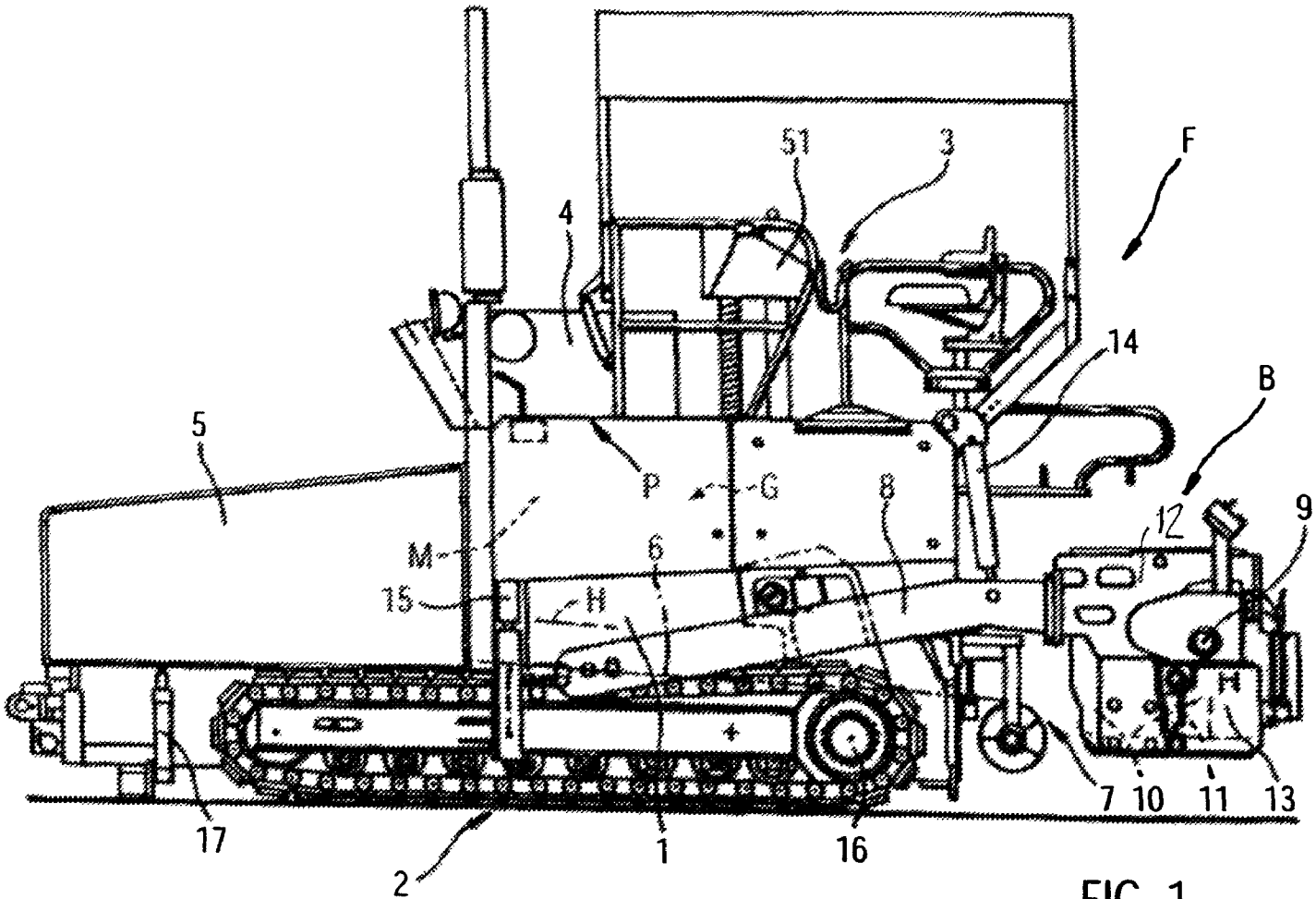

The invention relates to a paver according to the preamble part of claim 1, and to a method according to the preamble parts of claims 9, 10, 11.

Pavers (EP 1 118 714 A, EP 0 489 969 A, DE 103 00 745 A1) comprise heating devices or powerful electric motors supplied with electric power from the generator needing at least temporarily high electric power, e.g. in the paver at a longitudinal conveyer or in a paving screed of the paver for tampers, compression bars, sole plates, and the like. The combustion engine drives, via a pump power take-off gear, several hydraulic pumps including a travel pump aggregate, all defining powerful functional units together with hydraulic motors or hydraulic cylinders correspondingly distributed in the paver and/or in the paving screed. All functional units here are driven permanently by the crankshaft of the combustion engine via a torsionally flexible clutch, e.g. via the pump power take-off gear, and may generate high drag loads for the combustion engine. In case of bad weather conditions and after long resting periods the drag loads hinder the starting process of the combustion engine. Also during a phase of heating up the heating devices, which first have to be brought to operation temperature before the paver starts to work, the combustion engine has to overcome the drag loads caused by other functional units which are not needed for this operational phase at first. This extends the heating up process undesirably and increases fuel consumption. Finally, the paver should travel during a transport phase as efficiently as possible which is hindered by the drag loads of the then not needed functional units, i.e., the maximum transport travelling speed becomes limited while at the same time fuel consumption increases. During such operational phases occurring in the gear mechanisms and/or power distributions and in the hydraulic system mechanical and hydraulic power losses unavoidably have to be compensated for which in particular in the case of cool hydraulic oil or gear mechanism oil are significant and consume more power from the combustion engine as is basically needed for such operational phases.

It is known from the leaflets "Vögele Straβenfertiger SUPER 1700, SUP=ER 1704" and "Vögele SUPER 170 and SUPER 174" of the company Joseph Vögele AG, Neckarauerstraβe 168-228, 6800 Mannheim 1, Germany, issued during the 70s and 80s, respectively page 3, to provide a shiftable dry disc clutch between the combustion engine and a drive shaft extending to a shift gear mechanism comprising hydrostatic splitter boxes.

The generator and several hydraulic pumps for functional units are driven via a multiple belt drive at the entrance of the shift gear mechanism. A compressor needed to supply the steering mechanism and the braking system and a hydraulic pump for a power steering mechanism are permanently driven separately by the combustion engine and generate permanent drag loads. When the clutch is disengaged neither the generator nor the hydraulic pumps are driven by the multiple belt drive. In the neutral position of the shift gear mechanism and during transport travel with the clutch engaged the generator and the hydraulic pumps are driven as well and significantly deteriorate the energy balance of the combustion engine. The clutch is disengaged respectively only when changing gear in the shift gear mechanism, e.g. by using a clutch pedal or, in some cases when starting the combustion engine, however, subsequently immediately is engaged again in order not to force the operator to hold the clutch pedal depressed and not to mechanically overload the disengaged dry disc clutch.

In the field of agricultural machines power dividers are known which are provided for other reasons. Such power dividers include at least one permanently driven power branch and further power branches which can be switched in or switched off selectively. The requirements for agricultural machines cannot be compared with the specific requirements for pavers. The requirements for pavers are dictated among others by the paving material which has to be worked, the heating and dosing of the paving material, and the drive, the heating and control of the functional units in the paver and/or in the paving screed when casting a mat from the paving material.

Modern pavers, meanwhile, are equipped with a plurality of hydraulically actuated functional units and no longer have a travelling drive system with a mechanical shift gear mechanism. Examples of such hydraulically operable functional units are: hydrostatic travelling drives, hydrostatic steering drives, hydrostatic differential drives, hydrostatic all wheel drives, all equipped with hydraulic brakes, furthermore, conveying devices and dosing devices, lateral distribution augers, auger conveyers, auger suspension adjustment devices, hopper wall hydrocylinders, levelling cylinders, spraying devices for spraying bonding agents, tampers, vibrators, pressing bars, adjustment devices for adjusting components in the paving screed, and the like in lateral direction, in longitudinal direction, for inclinations and elevations. As a consequence of the plurality and at least partially very powerful functional units the resulting drag loads for the combustion engine amount to about one third or even more of the actual power output of the combustion engine, whenever the functional units are not working. As a result and since additionally several hundreds of liters of hydraulic oil are circulating in the system and cause marked pumping losses, and since also variations of the paver travelling resistance depending on the weather, the load condition and the gradient of the roadbed, an inexpediently high specific fuel consumption will result during start-up, warming-up and during transport travel, particularly when travelling on an ascending slope, and even during standstill of the road paver while heating-up the heating devices, and finally during transport travel when maintaining the operation temperature of heated functional components, etc. This might result in some cases in starting problems for the combustion engine during cold weather and the like. In case of a paver of average size and an average workload the possible savings of fuel per year may amount to several thousands of liters of diesel fuel. Finally, the maintenance frequency of the paver is high due to the drag loads which permanently have to be overcome. Examples of requirements which are specific for pavers and would allow considerable fuel savings are: transport travel frequently lasting a long time, wide variations of the travelling resistance depending on the roadbed and slopes, long lasting warm-up or heat-up phases needed in case of bad weather conditions and after long pauses, or long lasting pauses in the work of the paver when casting a mat while waiting until paving material supply trucks arrive. Operating the combustion engine then while it overcomes the significant but unnecessary drag loads is extremely inefficient, contaminates the environment, causes high fuel consumption and increases the frequency of maintenance for the hydraulic system and the permanently operating functional units owing to wear build up. The drag load caused by the generator in case of only low electric power take off or without any electric power take off is almost negligible. The possible yearly savings of fuel for a paver of average size and average workloads amount particularly for such operation situations to several thousands of liters of diesel fuel. Thus, in order to protect the environment and for cost reasons, nowadays there is a strong demand to significantly improve the energy balance of the combustion engine and to flexibly adapt the combustion engine to various operational situations.

It is an object of the invention to provide a paver and method allowing to improve the energy balance and the environmental friendliness of a road paver with a view to the specific requirements only occurring during the operation of a road paver.

This object is achieved by the features of claim 1, and according to the method by the features of claims 9, 10 and 11.

As, depending on the operational situation, at least one pump, expediently at least a pump for a powerful, intermittently working functional unit, is disconnected in the paver while the generator remains driven permanently, e.g. in order not to jeopardise the operability of the paver and to supply heating devices, and since that pump will be disconnected for a long duration depending on that operational situation, the drag load for the combustion engine is significantly reduced. In the case that the paver has stopped during such an operational situation even the powerful travel pump aggregate may be disconnected as well. The combustion engine thus starts more easily, has a more rapid warm-up phase, finishes a heating-up phase of heating devices via the generator earlier, allows to maintain operation temperatures of heated working components with reduced fuel consumption, and consumes significantly less fuel during transport travel or during waiting phases for a new batch of paving material. Furthermore, a heating-up phase of electric heating devices can be executed with optimised power. Overall, disconnecting at least one pump when not required under strict consideration of the specific requirements during operation of a paver in certain operation situations saves much fuel, relieves the environment, and reduces the frequency of necessary maintenances as well.

A transport phase at a higher transport speed and favourable fuel consumption may be carried out if then only the travel pump aggregate is driven alone as needed for the transport travel. Also the generator may be driven then while other pumps of functional units are disconnected, which functional units will not be needed during the transport phase. The drag load caused by the generator, in some cases, is in any case negligibly low during the transport phase.

During starting, and optionally while warming-up the combustion engine, at least one hydraulic pump will be disconnected or then even all not needed hydraulic pumps will be disconnected such that the combustion engine starts more easily and reaches the operational temperature quicker with lowered specific fuel consumption.

In an expedient embodiment of the paver the generator and the hydraulic pumps of the functional units commonly are driven by the crankshaft via a rotation elastic clutch which protects the combustion engine camshaft or the fly wheel of the combustion engine against torsional impacts. The generator and the pumps are combined in compact fashion at one engine end of the primary drive aggregate, optionally, including a power distributing power take-off gear for pumps. In an alternative embodiment the generator even could be driven permanently by the crankshaft at the crankshaft end opposite to the power take-off gear for pumps.

In an expedient embodiment a permanent drive train is provided between the crankshaft and the travel pump aggregate. The shiftable clutch is arranged between the crankshaft and the power take-off gear for the pumps of functional units. The shiftable clutch, preferably, is arranged at or in the power take-off gear for pumps. The travel pump aggregate may be flanged to the power take-off gear for pumps and is driven permanently by the combustion engine via the drive train extending through the power take-off gear for pumps. The shiftable clutch, expediently, is disengaged when the paver is in transport travel and/or is started or while the combustion engine is warming up and/or while heating devices are heated to their operational temperatures or are held at their operational temperatures.

In an expedient embodiment the generator and the travel pump aggregate are commonly and permanently driven via the drive train while at least one pump of further functional units is disconnected via the at least one shiftable clutch. The travel pump aggregate is operated for the transport travel while further pumps are disconnected. The generator produces in most cases only a negligible drag load during transport travel and may, if needed, supply heating devices or other electric power consumers upon demand.

In a further expedient embodiment all pumps at the power take-off gear for pumps, including the travel pump aggregate, are arranged such that they can be disconnected selectively by the shiftable clutch. A single shiftable clutch is needed which disconnects the drag loads when disengaged. The clutch is configured such that it will not be damaged even when being disengaged for a longer time.

In a further expedient embodiment single shiftable clutches are provided between the crankshaft of the combustion engine and the pumps for functional units, optionally, including the travel pump aggregate. These single shiftable clutches, preferably, are arranged at or within the power take-off gear for pumps or in power branches leading to the pumps for the functional units. In this fashion and upon demand the drag load of an individual functional unit or the drag loads of several or of all functional units may be disconnected, e.g. in order to improve the starting behaviour of the combustion engine, to allow to execute for transport travels with favourable fuel consumption, or in order to rapidly heat heating devices to operation temperature.

Expediently, the respectively provided clutch is shifted electrically, pneumatically, hydraulically or mechanically. During normal operation of the paver, i.e. during the so-called casting working travel, when a mat is cast on the roadbed by the paving screed, the clutch or all clutches are engaged. For example, in the case of a hydraulically shiftable clutch or of several hydraulically shiftable clutches a permanently driven low power hydraulic pump may also be coupled to the permanently driven generator. This hydraulic pump e.g. generates supply pressure for basic functions and even the respective clutch.

In a further expedient embodiment the generator is mounted at the power take-off gear for pumps or even separately from the power take-off gear for pumps in the chassis of the paver. The generator is connected to a power branch of the power take-off gear for pumps or to the drive train or directly to the crankshaft, e.g. via a belt drive or a drive shaft. In the case that the generator is mounted at the power take-off gear for pumps or at an engine suspension, a compact primary drive aggregate including the power take-off gear for pumps and the generator will result, and relative movements between the generator and the combustion engine do not occur which otherwise may cause excessive loads in the drive connection. In the case that the generator is mounted separately from the power take-off gear for pumps in the chassis of the road paver, a favourable position of the generator can be chosen, e.g. with a view to weight distribution in the chassis of the paver. Then, furthermore, the power take-off gear for pumps is relieved from the load and weight of the generator. A belt drive facilitates to drive the generator for generating power with optimum speed.

Figure 2:
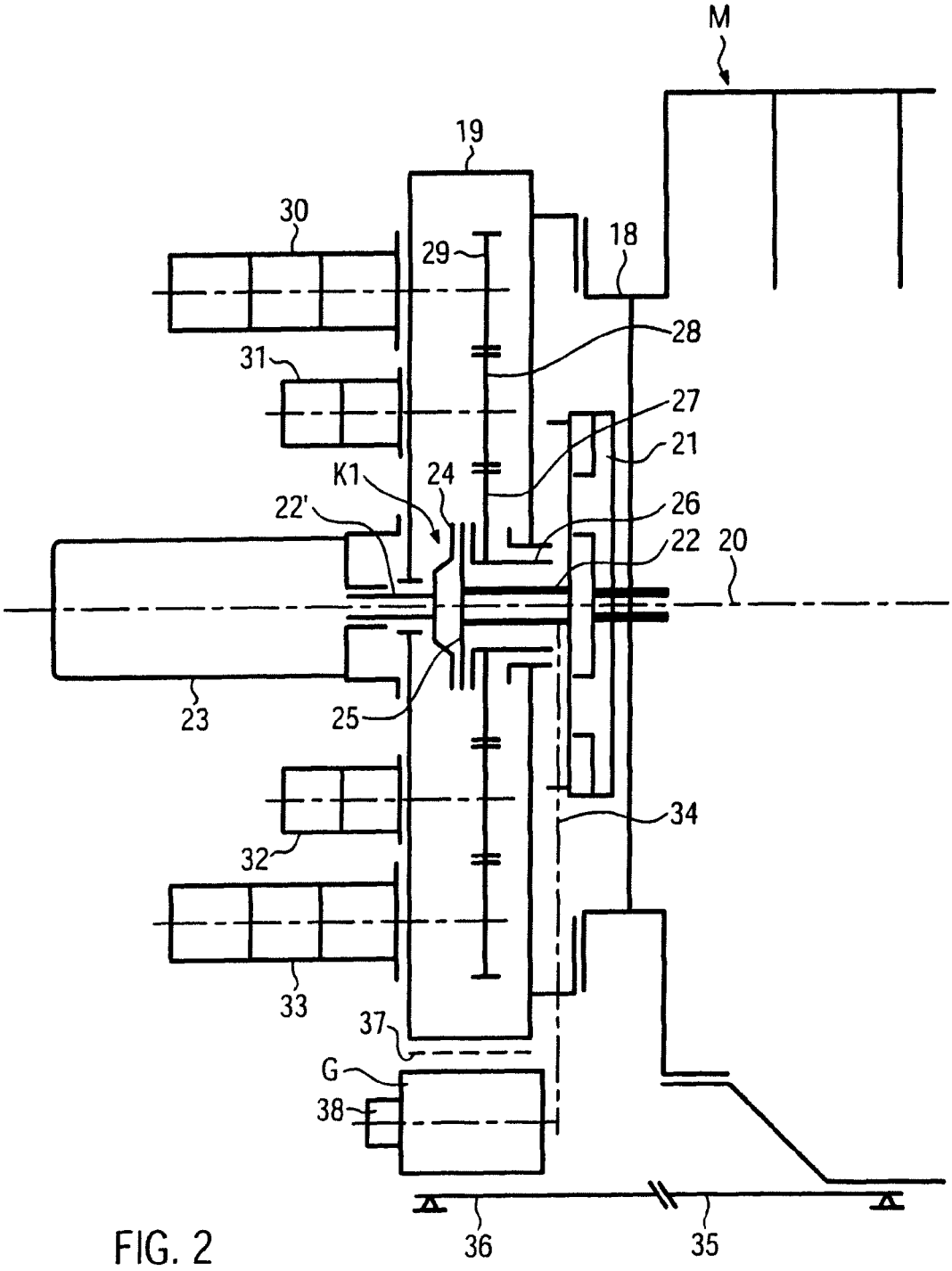
Figure 3:
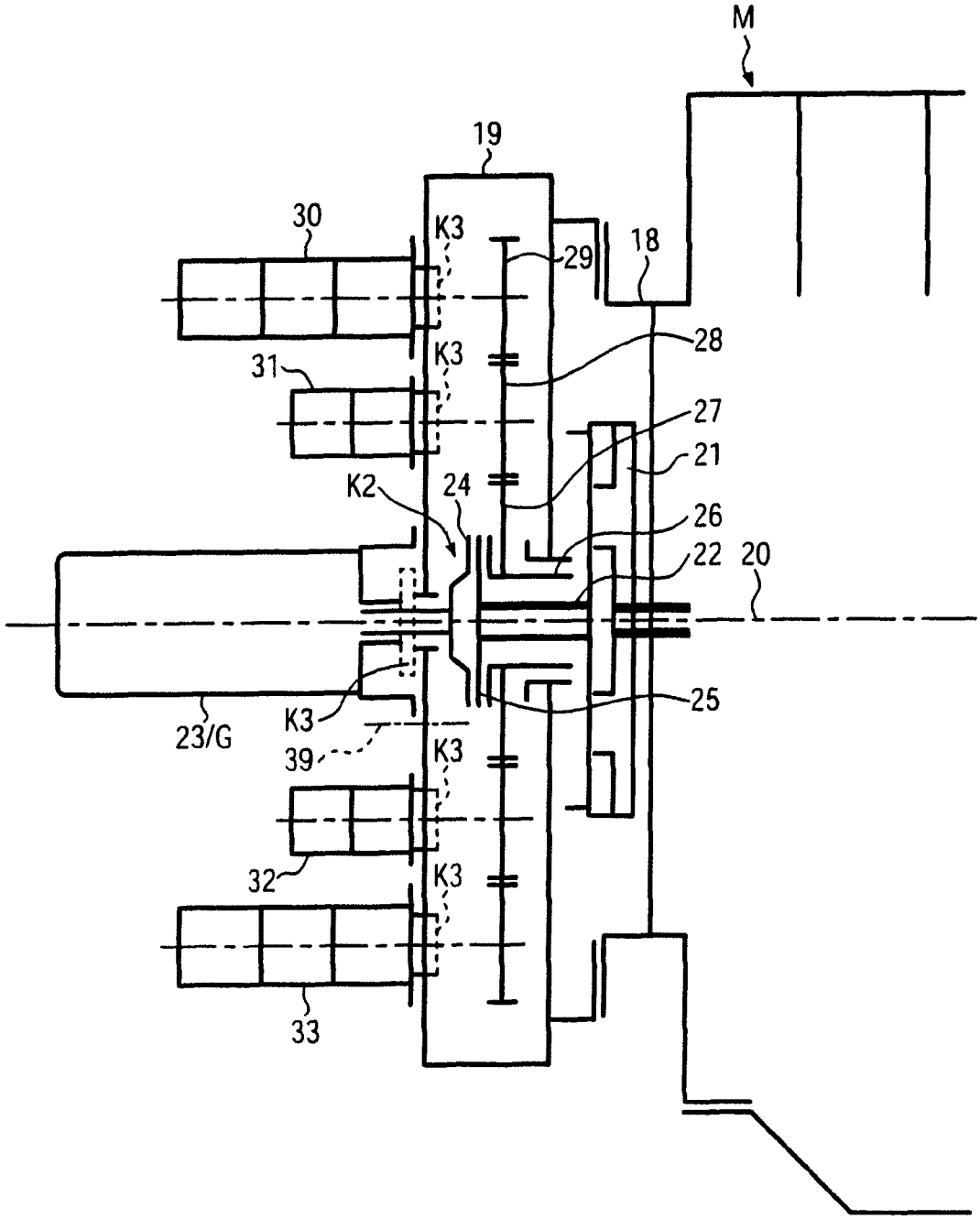

Embodiments of the invention will be explained with the help of the drawings. In the drawings is:

FIG. 1 a schematic side view of a paver,

FIG. 2 a schematic illustration of a part of a primary drive aggregate of a paver, and FIG. 3 a schematic illustration of a gear mechanism of a primary drive aggregate of a paver in a further embodiment.

A self-propelled paver F (FIG. 1) for producing traffic surfaces or paving mats from e.g. bituminous and hot paving material while travelling with extremely slow working travelling speed also may travel with significantly higher transport travelling speed. The paver F has a travelling undercarriage 2 at a chassis 1. The shown undercarriage 2 is a caterpillar undercarriage. Alternatively a wheeled undercarriage (not shown) could be provided. The travelling undercarriage 2 is driven by at least one hydraulic drive motor 16. A hopper 5 for paving material is arranged in a front region of the chassis 1. A longitudinal conveying device 6 extends within and through the chassis 1 to a lateral distribution assembly 17 arranged at the rear end of the chassis 1. The lateral distribution assembly 17 typically is a hydraulically driven lateral distribution auger. The longitudinal conveying device 6 e.g. may be driven by not shown hydraulic motors and even may comprise an electric heating device H. The lateral distribution assembly 17 is arranged in front of a paving screed B which is towed at towing bars 8 by the road paver F. The paving screed B has to level and/or compact the paving material. The towing bars 8 are linked to the chassis 1. Their linking points can be adjusted in elevation by means of hydromotors 15, e.g. hydraulic cylinders. Furthermore, lift hydromotors 14, e.g. hydraulic cylinders, are connected between the towing bars 8 and the chassis 1. The hydromotors 14 e.g. are actuated during a transport travel in order to hoist and hold the paving screed E in a lifted position shown in FIG. 1. The hydromotors 14 also may be actuated during working travel in certain operational phases. An operator's platform 3 is located on the upper side of the chassis 1 and comprises a control and operating console 51. A primary drive aggregate P is arranged below a cover 4 in the chassis 1. The primary drive aggregate P includes a combustion engine M, typically a diesel engine, and drives a generator G for supplying at least electric heating devices H in the road paver F and/or in the paving screed B and/or to supply functional units including electric motors in the road paver F and/or in the paving screed B.

The paving screed B e.g. has a base screed 12 connected with the towing bars 8, and extension screeds 13 which can be extended sidewardly. The base screed 12 and the extension screed 13 are respectively equipped with tampers 10, 11 and/or pressing bars (not shown) and vibration assemblies for sole plates. The tampers 10, 11, the pressing bars, and/or the sole plates are equipped with electric heating devices H. The extension screeds 13 e.g. can be shifted inwardly and outwardly on the base screed 12 by hydromotors 9, e.g. hydraulic cylinders.

The hydraulic motors (hydraulic cylinders) and the electric heating devices and/or the electric motors define, in combination with the generator and with hydraulic pumps driven by the primary drive aggregate P, several functional units of the road paver all consuming power generated by the primary drive aggregate P.

FIG. 2 indicates the driving schema of several functional units. The functional units as illustrated are without their respective working components. They (the hydraulic cylinders, the hydraulic motors, and the like) are supplied with hydraulic power and are distributed within the road paver F and/or within the paving screed B, as mentioned. Furthermore, other necessary and conventional equipments like a reservoir for hydraulic oil, connection pipes or hoses, regulating and control means, and the like, are not shown in FIG. 2.

The combustion engine M has a clutch housing or fly wheel housing 18 to which a power take-off gear 19 for pumps is flanged which drives and/or supplies the pumps of the functional units. A crankshaft 20 of the combustion engine M drives via a torsional elastic clutch 21 a drive train 22 leading to a shiftable clutch K1 arranged at the power take-off gear 19 for pumps (or as shown, within the power take-off gear 19 for pumps). The clutch K1 can be shifted between an engaged position and a disengaged position in hydraulic, pneumatic, electric or mechanic fashion. In FIG. 2 the clutch K1 is arranged between the drive train 22 and a coaxial extension 22' of the drive train 22. The extension 22' leads to a travel pump aggregate 23 of a travel functional unit to which e.g. the drive motors 16 belong. In the shown embodiment the travel pump aggregate 23 is centrally flanged to the power take-off gear 19 for pumps.

The shiftable clutch K1 (e.g. a hydraulic disc clutch) has at least one clutch part 25 permanently connected to the drive train 22. The clutch part 25 is fixedly connected in the engaged position of the clutch K1 with a clutch part 24 to the extension 22' and, at the same time, to a hollow shaft 26. The hollow shaft 26 drives several reduction stages 27, 28, 29 inside the power take-off gear 19 for pumps. The reduction stages 27, 28, 29, in turn, are driving hydraulic pumps or pump aggregates 30, 31, 32, 33. The generator G either is mounted at the power take-off gear 19 for pumps (at location 37) or is mounted at a suspension 36 in the chassis 1 of the road paver F, or is mounted at a console of the combustion engine A itself. The generator G e.g. is driven by a permanent drive connection 34 (e.g. a belt drive or a drive shaft).

The clutch K1 is in engaged condition in FIG. 2. All reduction stages 27, 28, 29, the travel pump aggregate 23 and the generator G are driven by the crankshaft 20 of the combustion engine. If the clutch K1 is disengaged, at least one pump is disconnected from the drive train 22 or the crankshaft 20, in the case shown, all pumps 30 to 33, and even the travel pump aggregate 23, as also the reduction stages 27, 28, 29 in the power take-off gear 19 for pumps (no churning losses, no cogging) will be disconnected. The clutch K1 may remain disengaged without danger of damage for longer periods.

The embodiment in FIG. 3 indicates various driving schemata.

The drive train 22 which is connected via the torsional flexible clutch 21 with the crankshaft 20 leads in this case to the travel pump aggregate 23 centrally flanged to the power take-off gear 19 for pumps such that the travel pump aggregate 23 is permanently driven. A shiftable clutch K2 is located on the drive train 22 and drives, in engaged condition, via the hollow shaft 22, the reduction stages 27, 28, 29 of the power take-off gear 19 for pumps and the pumps 30 to 33. In disengaged condition of the clutch K2, the reduction stages 27, 28, 29 and pumps 30 to 33 are disconnected while the travel pump aggregate 23 remains permanently driven. The generator G may be permanently driven as shown in FIG. 3 or is even combined with the travel pump aggregate 23 and is then driven by the drive train 22.

In an alternative embodiment in FIG. 3 the generator G is flanged to the power take-off gear 19 for pumps instead of the travel pump aggregate 23, and is permanently connected to the crankshaft 20 via the drive train 22. In this case, e.g. the travel pump aggregate 23 is connected to a further power branch 39 of the power take-off gear for pumps 19. In disengaged condition of the clutch K2 the travel pump aggregate 23 is also disconnected while the generator G is driven permanently.

As an option in FIG. 2 a pump 38 is shown at the permanently driven generator G. The pump 38 is driven permanently and supplies basic functions, e.g. the respective hydraulically shiftable clutch K1, K2, K3 with hydraulic power.

A further alternative in FIG. 3 is indicated in dotted lines. A respective shiftable clutch K3 is functionally associated to each pump group or each pump aggregate (several pump stages) 30 to 33, and also to the travel pump aggregate 23. The respective shiftable clutch K3 is expediently arranged in the respective power branch of the power take-off gear 19 for pumps. The shiftable clutch K2 is dispensed with in this case. The drive train 22 may be connected permanently with the reduction stage 27 in the power take-off gear 19 for pumps. Alternatively, however, even a single clutch K3 could be provided there.

As needed, all, several or even a single one of the pumps 30 to 33, 23 can be disconnected from the power branches in the power take-off gear 19 for pumps via the clutches K3 which may be shifted one by one or in groups or altogether. In this case the combustion engine M drives the drive train 22 and, optionally, the reduction stages 27, 28, 29 of the power take-off gear for pumps 19, and permanently only the generator G.

In order to improve the energy balance of the combustion engine M in FIG. 2 the clutch K1 is shifted into the disengaged condition when starting the combustion engine M and, optionally, during a warm-up phase of the combustion engine M such that all unnecessary drag loads are then disconnected from the crankshaft 20 or the drive train 22. The combustion engine M starts easier or reaches the operation temperature faster. As soon as the road paver F starts working travel (or transport travel) the clutch K1 is shifted into the engaged position such that all functional units are driven. The generator G, anyhow, is driven permanently.

In the embodiment in FIG. 3 and with the clutch K2 e.g. clutch K2 is shifted into the disengaged condition for starting the combustion engine M and, optionally, also during the warm-up phase such that the pump groups 30 to 33 and, optionally the travel pump aggregate 23, are disconnected or such that only the travel pump aggregate 23 and the generator G are driven permanently. In the case that the travel pump aggregate 23 is flanged centrally to the power take-off gear 19 for pumps, the road paver F with the disengaged clutch K2 travels during transport at higher transport speeds and with favourable fuel consumption because the drag loads of the further functional units do not need to be overcome. However, the permanently driven generator G may nonetheless heat-up the heating devices H to operational temperatures while the road paver has stopped and before the further functional units become connected via the clutch K2. In the case that also the travel pump aggregate 23 is driven permanently, the road paver F can travel for transport with high transport speed and favourable fuel consumption without unnecessary drag loads.

If, however, as shown in FIG. 3 in dotted lines, single shiftable clutches K3 are arranged in the power branches of the power take-off gear 19 for pumps to the pumps 30 to 33, 23 (the clutch K2 of FIG. 3 is dispensed with) then each or several or all pumps can be driven or disconnected upon demand. During transport travel of the road paver F at transport speed e.g. only the clutch K3 for the travel pump aggregate 23 is engaged, while the further pumps 30 to 33 remain disconnected. For heating-up the heating devices H also the clutch K3 of the travel pump aggregate 23 or the generator may be brought into engaged condition, while the other pumps 30 to 33 remain disconnected.

The single shiftable clutches K3 in FIG. 3 allow to drive or disconnect each functional unit upon demand. These clutches K3 optimise the energy balance of the combustion engine M selectively for the start and the warm-up phase, for the transport travel, or for heating-up the heating devices individually.

The respective clutch K1, K2, K3 may, selectively, be actuated also during pauses of the working operation of the road paver F, e.g. while the road paver F waits until fresh paving material arrives.

The respective clutch K1, K2, K3 may be actuated by the operator at the operator's platform 3 or by accompanying personnel at an exterior control stand, e.g. at the paving screed B, or may be actuated fully automatically or semi-automatically using respective programs of the control device of the paver. In the latter case monitoring assemblies and/or detecting assemblies might be provided in order to detect an operational situation for which it is expedient to disconnect or connect certain drag loads.

The concept which facilitates to disconnect at least one hydraulic pump from the combustion engine while the generator is permanently driven allows among others to significantly improve the engine balance of the road paver due to significant fuel savings during individual operational situations.

The invention claimed is:

1. A paver comprising a primary driving aggregate having a combustion engine, functional units including a travel pump aggregate supplying a travel drive and having at least one-hydraulic pump driven from a crankshaft of the combustion engine at least one electric generator mounted on a power take-off gear for the at least one hydraulic pump and connected to the combustion engine for supplying at least electric heating devices of the paver and/or of a paving screed of the paver with electric power, a permanent drive train between the crankshaft and the electric generator, the electric generator being directly connected with the permanent drive train via a belt drive or a drive shaft, and at least one shiftable clutch for disconnecting the at least one hydraulic pump from the crankshaft.

2. The paver of claim 1, wherein the permanent drive train penetrates the take-off gear for the at least one hydraulic pump and is located between the crankshaft and the travel pump aggregate for commonly and permanently driving the electric generator and the travel pump aggregate, the travel pump aggregate is flanged to the power take-off gear for the at least one hydraulic pump, and wherein-the at least one shiftable clutch is arranged between the crankshaft and the power take-off gear for the at least one hydraulic pump.

3. The paver of claim 1, wherein the at least one hydraulic pump, and the travel pump aggregate are connected to the power take-off gear for the at least one hydraulic pump and can be disconnected from the drivetrain with the shiftable clutch.

4. The paver of claim 1, wherein a plurality of single shiftable clutches are arranged between the crankshaft and a plurality of pumps or pump aggregates of the functional units, including the travel pump aggregate, and wherein the single shiftable clutches are located at or in the power take-off gear for the pumps, the take-off gear being flanged to a flywheel housing of the combustion engine.

5. A method for heating-up heating devices supplied with electric power by at least one electric generator of a self-propelled paver, the paver having a primary driving aggregate with a combustion engine, the paver comprising in addition to the heating devices in the paver and/or in a paving screed of the paver further functional units with hydraulic pumps including a travel pump aggregate supplying a travel drive and having at least one hydraulic pump, the hydraulic pump being driven by the primary driving aggregate, the at least one electric generator being connected to the engine, the electric generator being directly connected with a permanent drive train via a belt drive or a drive shaft, and at least one shiftable clutch for disconnecting the at least one hydraulic pump from the crankshaft, wherein the method comprises selectively disconnecting from the combustion engine the at least one hydraulic pump during a heating-up phase of the heating devices via the electric generator which is permanently driven by the combustion engine.

6. A method for driving a self-propelled paver during a transport travel phase, the paver comprising a primary driving aggregate with a combustion engine, at least one electric generator for supplying electric heating devices in the paver and/or in a paving screed of the paver with electric power, functional units, including at least one travel pump aggregate, with at least one hydraulic pumps driven by the primary driving aggregate, the at least one electric generator being connected to the combustion engine, the electric generator being directly connected with a permanent drive train via a belt drive or a shaft, and at least one shiftable clutch for disconnecting the at least pump from the crankshaft, wherein the method comprises selectively disconnecting at least one pump of the functional units, except the travel pump aggregate, and the generator during transport of the paving material.

7. A method for starting, and optionally, warming-up a combustion engine of a primary driving aggregate of a paver, the paver comprising at least one electric generator for supplying electric heating devices in the paver and/or in a paving screed of the paver with electric power, and functional units having hydraulic pumps, including a travel pump aggregate supplying a travel drive, said hydraulic pumps being driven by the primary driving aggregate, the at least one electric generator being connected to the combustion engine, the electric generator being directly connected with a permanent drive train via a belt or a shaft, and at least one shiftable clutch for disconnecting the at least one pump from the crankshaft, wherein the method comprises selectively disconnecting from the combustion engine during starting and, optionally, during a warming-up phase of the combustion engine at least one of the hydraulic pumps but not disconnecting the electric generator.

8. The paver of claim 4 wherein the single shiftable clutches are located in power branches of the power take-off gear for the pumps, and the power branches are connected to the pumps that are flanged to the power take-off gear.

9. A paving machine comprising an internal combustion engine, a plurality of functional units, each of said units being operated by a hydraulic pump driven by the combustion engine, an electric generator connected to the combustion engine for supplying electric power to one or more electric heating devices of the paver and/or of a paving screed of the paver, the electric generator being mounted on a power take-off gear for the hydraulic pump and being connected to the combustion engine, a drive train permanently connected between the combustion engine and at least the generator, the generator being directly connected with the permanent drive train via a drive shaft or a belt drive, and at least one shiftable clutch for selectively disengaging at least one of the plurality of functional units from the internal combustion engine.

10. The paving machine of claim 9 further comprising a travel pump aggregate supplying a travel drive.

* * * * *